US012663007B2

(12) United States Patent
Murakami et al.

(10) Patent No.: US 12,663,007 B2
(45) Date of Patent: Jun. 23, 2026

(54) SCROLL COMPRESSOR AND REFRIGERATION APPARATUS INCLUDING THE SAME

(71) Applicant: DAIKIN INDUSTRIES, LTD., Osaka (JP)

(72) Inventors: Yasuhiro Murakami, Osaka (JP); Yasuo Mizushima, Osaka (JP); Takeshi Endo, Osaka (JP); Akira Himeda, Osaka (JP); Tsuyoshi Fukunaga, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 19/089,721

(22) Filed: Mar. 25, 2025

(65) Prior Publication Data

US 2025/0223965 A1 Jul. 10, 2025

Related U.S. Application Data

(63) Continuation of application No. PCT/JP2023/036185, filed on Oct. 4, 2023.

(30) Foreign Application Priority Data

Oct. 31, 2022 (JP) ..... 2022-174423

(51) Int. Cl.
*F04C 18/02* (2006.01)
*F04C 29/02* (2006.01)

(52) U.S. Cl.
CPC ..... *F04C 18/0215* (2013.01); *F04C 29/02* (2013.01); *F04C 29/026* (2013.01); *F04C 2240/30* (2013.01)

(58) Field of Classification Search
CPC .... F04C 18/0215; F04C 29/02; F04C 29/026; F04C 2240/30
See application file for complete search history.

(56) References Cited

U.S. PATENT DOCUMENTS 6,322,339 B1 * 11/2001 Mitsunaga ..... F04C 29/02 418/55.6
7,322,809 B2 * 1/2008 Kitaura ..... F04C 29/023 418/55.6

(Continued)

FOREIGN PATENT DOCUMENTS

JP 2017-25762 A 2/2017

OTHER PUBLICATIONS

Chinese Patent Publication and Machine translation for CN 216922510 U; 1st Inventor: Huang; Title: Horizontal Vortex Compressor; Published: Jul. 8, 2022. (Year: 2022).*

(Continued)

*Primary Examiner* — Mary A Davis
(74) *Attorney, Agent, or Firm* — Spencer Fane LLP

(57) ABSTRACT

A scroll compressor includes a casing, a partition member, a compression element, and first and second flow paths provided in the partition member. The casing has a cylindrical shape with an internal space for lubricating oil. The partitioning member is fixed to the casing to divide the internal space into first and second spaces. The compression element includes fixed and movable scrolls to discharge refrigerant to the first space. The first flow path allows refrigerant to pass from the first space to the second space. The second flow path is apart from the first flow path. The second flow path guides the lubricating oil to the second space, and includes a narrow portion having a smallest flow (Continued)

path area. A ratio of a hydraulic diameter of the narrow portion to a length of the narrow portion in an axial direction of the casing is 0.01 to 0.07.

20 Claims, 13 Drawing Sheets

(56) References Cited

U.S. PATENT DOCUMENTS

| | | | | |
|---|---|---|---|---|
| 9,541,310 | B2 * | 1/2017 | Yokoyama | F04C 29/026 |
| 2016/0047380 | A1 | 2/2016 | Kim et al. | |

OTHER PUBLICATIONS

International Preliminary Report of corresponding PCT Application No. PCT/JP2023/036185 dated May 15, 2025.
International Search Report of corresponding PCT Application No. PCT/JP2023/036185 dated Nov. 21, 2023.
European Search Report of corresponding EP Application No. 23 88 5432.7 dated Jan. 29, 2026.

* cited by examiner

SCROLL COMPRESSOR AND REFRIGERATION APPARATUS INCLUDING THE SAME

CROSS-REFERENCE TO RELATED APPLICATIONS

This is a continuation of International Application No. PCT/JP2023/036185 filed on Oct. 4, 2023, which claims priority under 35 U.S.C. § 119 (a) to Patent Application No. 2022-174423, filed in Japan on Oct. 31, 2022, all of which are hereby expressly incorporated by reference into the present application.

BACKGROUND

Technical Field

The present disclosure relates to a scroll compressor, and particularly to a scroll compressor that is less likely to exhaust lubricating oil unintentionally.

Background Information

Japanese Laid-Open Patent Publication No. 2017-025762 A discloses a scroll compressor.

SUMMARY

A scroll compressor according to an aspect includes a casing, a partitioning member, a compression element, a first flow path, and a second flow path. The casing includes an internal space in which a lubricating oil exists. The casing has a cylindrical shape. The partitioning member is fixed to the casing and divides the internal space into a first space and a second space. The compression element includes a fixed scroll and a movable scroll. The movable scroll can move relative to the fixed scroll. The compression element discharges a refrigerant to the first space. The first flow path is provided in the partitioning member. The first flow path allows the refrigerant to pass through from the first space to the second space. The second flow path is provided in the partitioning member so as to be apart from the first flow path. The second flow path is configured to guide the lubricating oil to the second space. The second flow path includes a narrow portion. The narrow portion has a smallest flow path area. A ratio of a hydraulic diameter of the narrow portion to a length of the narrow portion in an axial direction of the casing is 0.01 or more and 0.07 or less.

In this configuration, in addition to the first flow path for the refrigerant, the second flow path dedicated to the lubricating oil is provided in the partitioning member. Since the narrow portion of the second flow path has a shape defined by $0.01 \leq D/L \leq 0.07$, the second flow path allows the lubricating oil in a liquid state to pass through and exhibits resistance to the refrigerant in a gas state. Therefore, since opportunities of mixing the refrigerant and the lubricating oil are reduced, oil loss is suppressed.

DETAILED DESCRIPTION OF EMBODIMENT(S)

First Embodiment (1) Configuration of Refrigeration Apparatus 101

Figure 1:
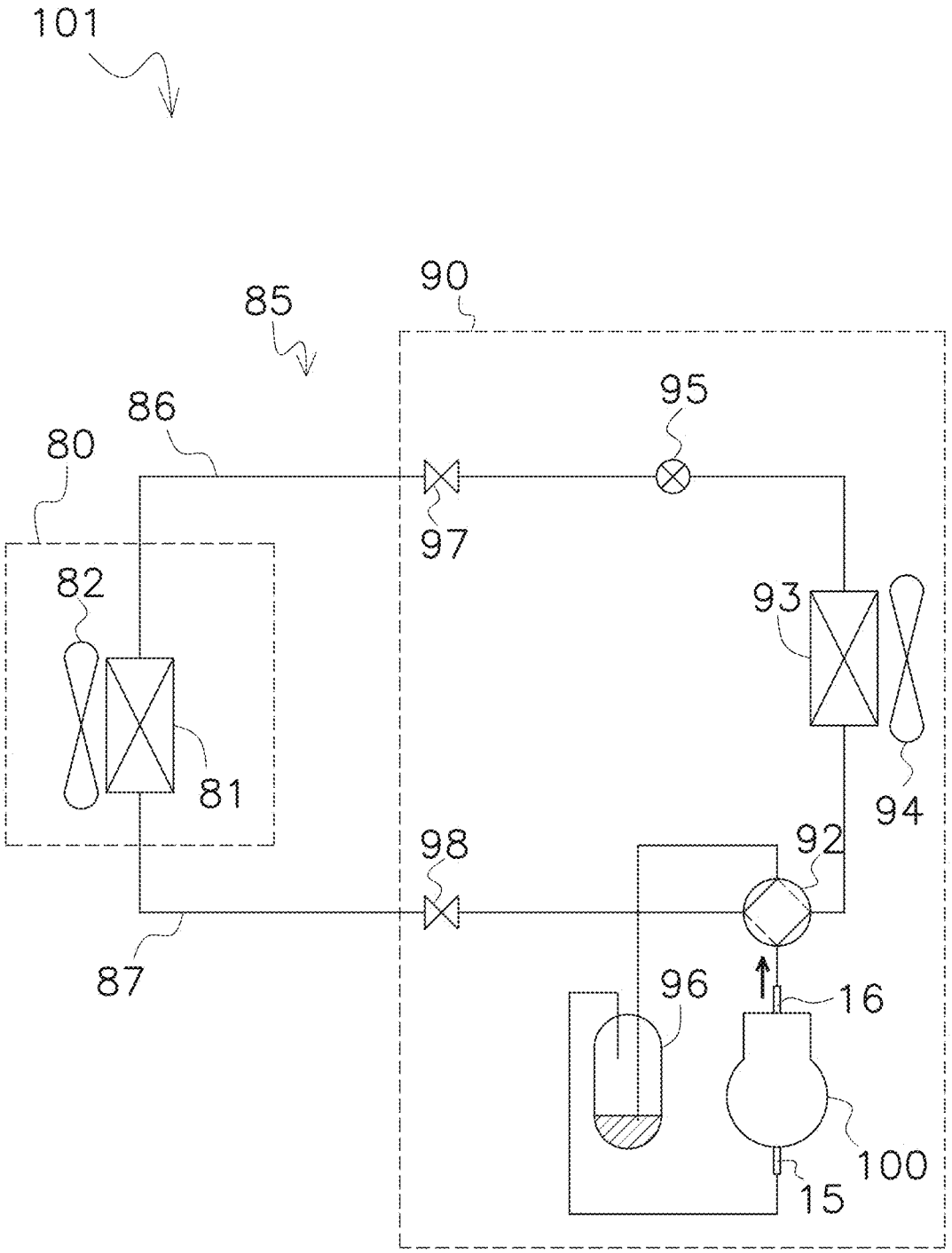
FIG. 1 is a refrigerant circuit diagram showing a configuration of a refrigeration apparatus 101.

FIG. 1 shows a configuration of a refrigeration apparatus 101 according to a first embodiment. The refrigeration apparatus 101 includes a heat source unit 90, a utilization unit 80, and a connection pipe group 85.

The heat source unit 90 functions as a heat source or a cold source for a refrigerant. The heat source unit 90 includes a scroll compressor 100, a four-way switching valve 92, a heat source heat exchanger 93, a heat source fan 94, an expansion valve 95, an accumulator 96, a liquid shutoff valve 97, and a gas shutoff valve 98.

The utilization unit 80 provides a user with heat or cold received from the refrigerant. The utilization unit 80 includes a utilization heat exchanger 81 and a utilization fan 82.

The connection pipe group 85 connects the heat source unit 90 and the utilization unit 80. The connection pipe group 85 includes a liquid pipe 86 and a gas pipe 87. The liquid pipe 86 connects the liquid shutoff valve 97 and the utilization heat exchanger 81. The gas pipe 87 connects the gas shutoff valve 98 and the utilization heat exchanger 81.

The scroll compressor 100 compresses a low-pressure gas refrigerant to generate a high-pressure gas refrigerant. When the four-way switching valve 92 achieves the connection indicated by the solid line, the refrigeration apparatus 101 performs a cold utilization operation. At this time, the utilization heat exchanger 81 functions as an evaporator or a heat absorber, and provides the user with cold. When the four-way switching valve 92 achieves the connection indicated by the broken line, the refrigeration apparatus 101 performs a heat utilization operation. At this time, the utilization heat exchanger 81 functions as a condenser or a heat radiator, and provides the user with heat.

(2) Configuration of Scroll Compressor 100

Figure 2:
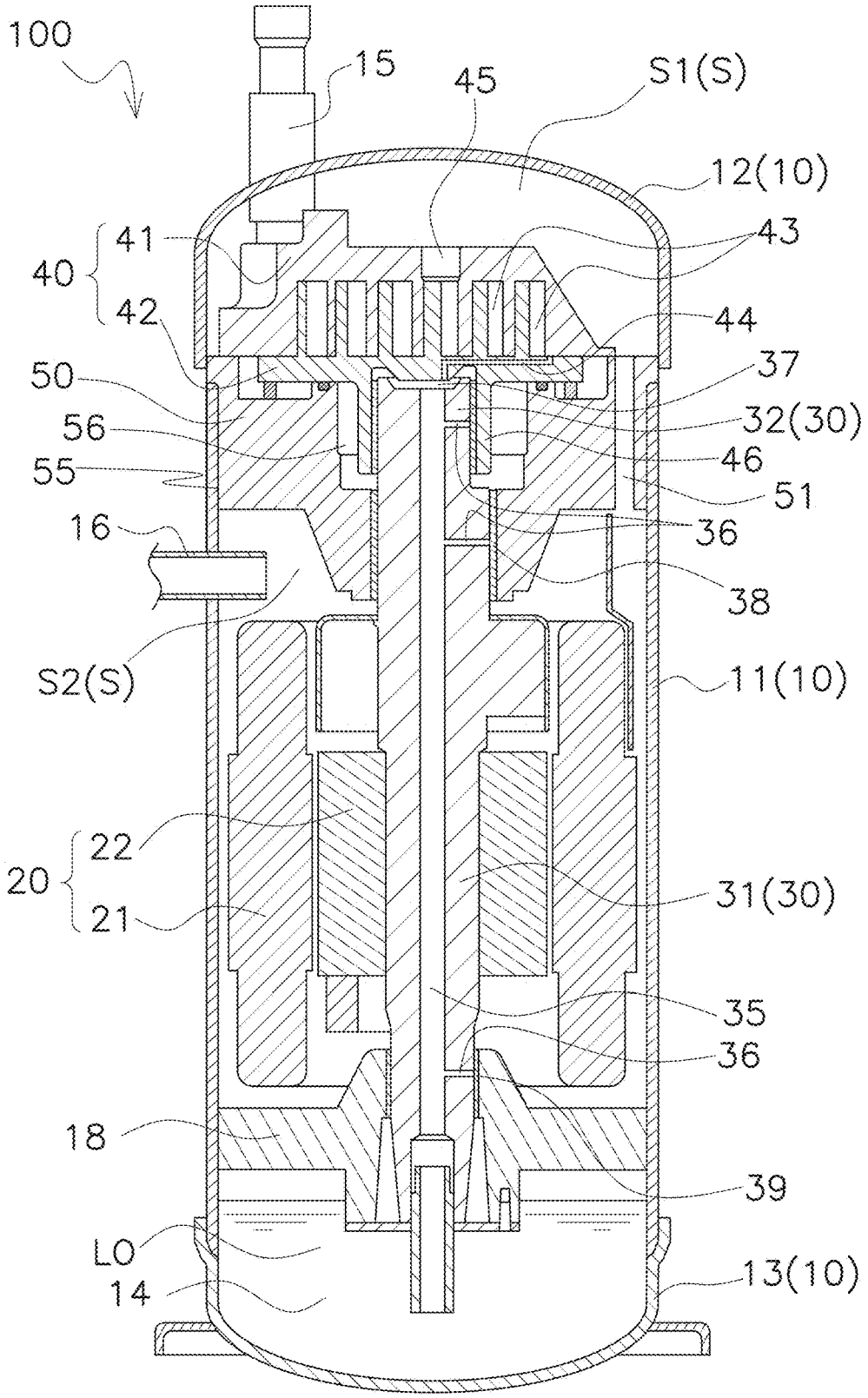
FIG. 2 is a sectional view of a scroll compressor 100 according to a first embodiment.

FIG. 2 shows a configuration of the scroll compressor 100. The scroll compressor 100 includes a casing 10, a motor 20, a crankshaft 30, and a compression element 40.

(2-1) Casing 10

The casing 10 includes a body 11, an upper portion 12, and a lower portion 13 that are airtightly joined together.

An internal space S exists in the casing 10. Components of the scroll compressor 100, the refrigerant, and a lubricating oil LO exist in the internal space S.

A suction pipe 15 for sucking the low-pressure gas refrigerant is attached to the upper portion 12. A discharge pipe 16 for discharging the high-pressure gas refrigerant is attached to the body 11. A partitioning member 50 and a support 18 are further attached to the body 11. The partitioning member 50 divides the internal space S into a first space S1 and a second space S2. The partitioning member 50 supports the compression element 40 and an upper portion of the crankshaft 30. The support 18 supports a lower portion of the crankshaft 30. An oil reservoir 14 for storing the lubricating oil LO is provided near the lower portion 13.

(2-2) Motor 20

The motor 20 generates power for driving the compression element 40 by using electric power supplied from the outside of the scroll compressor 100. The motor 20 includes a stator 21 and a rotor 22. The stator 21 is fixed to the body 11. The rotor 22 is disposed in a cavity in a central portion of the stator 21 and is rotatably supported.

(2-3) Crankshaft 30

The crankshaft 30 transmits the power generated by the motor 20 to the compression element 40. The crankshaft 30 includes a main shaft portion 31 and an eccentric portion 32 eccentric from the main shaft portion 31. A part of the main shaft portion 31 passes through a cavity in a central portion of the rotor 22 and is fixed to the rotor 22.

A main passage 35 for sucking up the lubricating oil LO in the oil reservoir 14 is provided inside the crankshaft 30. The main passage 35 communicates with a plurality of branch passages 36 extending in a radial direction of the crankshaft 30. The branch passages 36 are configured to supply the lubricating oil LO to a side surface of the main shaft portion 31 or the eccentric portion 32. The plurality of branch passages 36 guides the lubricating oil LO to a first bearing 37, a second bearing 38, and a third bearing 39.

(2-4) Compression Element 40

The compression element 40 generates a high-pressure gas refrigerant by compressing a low-pressure gas refrigerant by using the power transmitted by the crankshaft 30. The compression element 40 includes a fixed scroll 41 and a movable scroll 42. The fixed scroll 41 is supported by the partitioning member 50. The movable scroll 42 includes a boss 46. The eccentric portion 32 of the crankshaft 30 is fitted in a concave portion of the boss 46. A rotation of the crankshaft 30 is transmitted to the boss 46 via the first bearing 37, and accordingly, the movable scroll 42 revolves around the fixed scroll 41.

A plurality of compression chambers 43 is formed between the fixed scroll 41 and the movable scroll 42. The crankshaft 30 allows the movable scroll 42 to revolve, and thus, a volume of the compression chamber 43 changes, and the refrigerant is compressed. The generated high-pressure gas refrigerant is discharged into the first space S1 through a discharge hole 45 provided in the fixed scroll 41.

(3) Configuration of Partitioning Member 50

Figure 3:
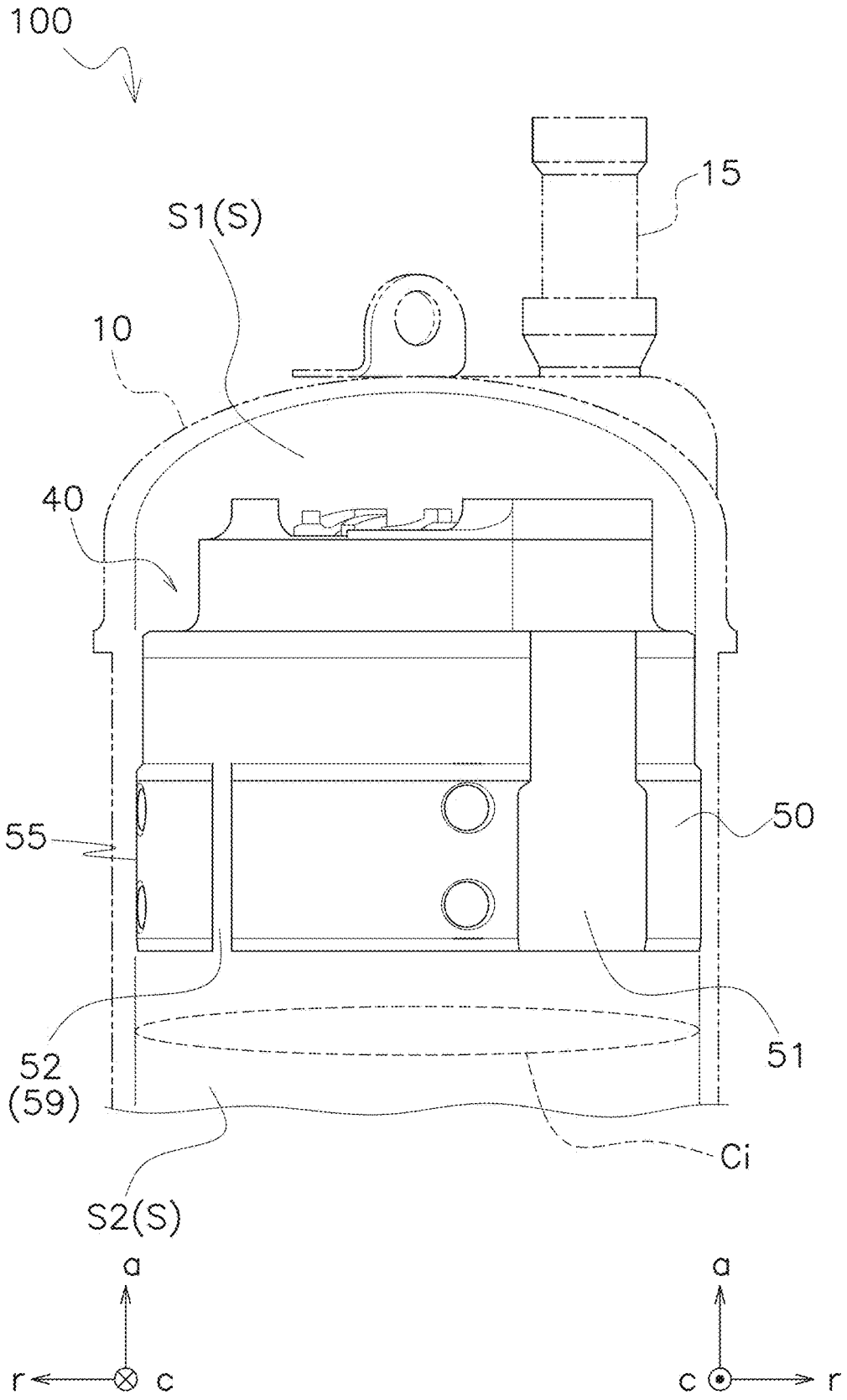
FIG. 3 is a schematic diagram of a main part of the scroll compressor 100 according to the first embodiment.

FIG. 3 shows a structure of the partitioning member 50 and a periphery of the partitioning member 50. The casing 10 has a cylindrical shape extending in an axial direction a. A cross section of the body 11 of the casing 10 is spaced apart in a radial direction r from a center and has a circular shape along a circumferential direction c orthogonal to the radial direction r. The drawing shows an inner circumference Ci of the body 11 of the casing 10.

In this drawing, it is also understood that the internal space S of the casing 10 is divided into the first space S1 and the second space S2 by the partitioning member 50. It is further understood that the partitioning member 50 supports the compression element 40. The partitioning member 50 has a fixing surface 55. The fixing surface 55 is fixed to the body of the casing 10. The partitioning member 50 has a diameter of 140 mm or more and 250 mm or less, for example. The body 11 of the casing 10 has an inner circumference Ci of 520 mm or more and 800 mm or less, for example. The partitioning member 50 is a separate component from the compression element 40.

Figure 4:
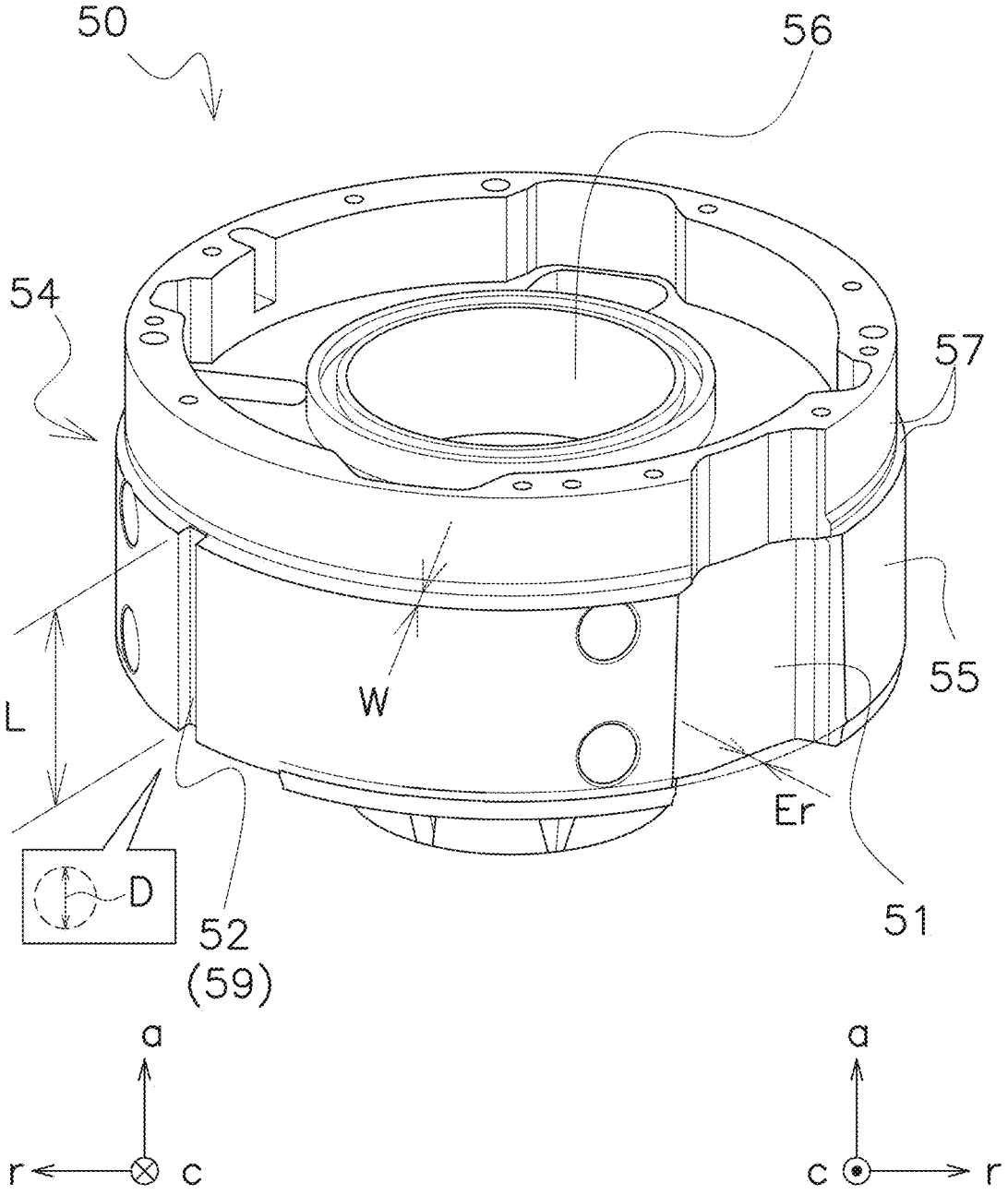
FIG. 4 is a perspective view of a partitioning member 50 according to the first embodiment.

FIG. 4 shows a detailed structure of the partitioning member 50. The partitioning member 50 has a peripheral edge 54. The fixing surface 55 and a stepped portion 57 exist on the peripheral edge 54. The fixing surface 55 is provided at a portion of the partitioning member 50 that bulges outward in the radial direction r of the body 11 of the casing 10, in other words, in the radial direction r of the partitioning member 50.

One first flow path 51 and one second flow path 52 are provided on the fixing surface 55. The second flow path 52 is spaced apart from the first flow path 51. The first flow path 51 allows the refrigerant to pass from the first space S1 to the second space S2. The second flow path 52 is configured to guide the lubricating oil LO to the second space S2.

The second flow path 52 has a narrow portion 59. The narrow portion 59 is a portion having the smallest flow path area in the second flow path 52. In the partitioning member 50 according to the present embodiment, since the second flow path 52 has a constant flow path area, the narrow portion 59 constitutes the entire second flow path 52.

The narrow portion 59 has a length L and a hydraulic diameter D. The length L is a dimension of the narrow portion 59 in the axial direction a of the casing 10. The hydraulic diameter D is a diameter of a circular sectional area of the narrow portion 59 having a sectional area that is not a circle when converted into a flow path having a circular sectional area. How to calculate a hydraulic radius is well known to those skilled in the art. The length L is, for example, 5 mm or more and 80 mm or less. A ratio D/L of the hydraulic diameter D to the length L is set to, for example, 0.01 or more and 0.07 or less. The ratio D/L is preferably set to, for example, 0.03 or more and 0.06 or less.

A dimension Er of the first flow path 51 in the radial direction r of the body 11 of the casing 10, in other words, in the radial direction r of the partitioning member 50 is, for example, 2 mm or more and 20 mm or less.

The stepped portion 57 is provided on an upper side of the fixing surface 55 at the peripheral edge 54 of the partitioning member 50. The stepped portion 57 faces the first space S1. The stepped portion 57 is retracted inward of the fixing surface 55 in the radial direction r by a retraction width W. The retraction width W is 3 mm or less, preferably 2 mm or less. The second flow path 52 communicates with the stepped portion 57.

The partitioning member 50 further includes an accommodation portion 56. The accommodation portion 56 accommodates the boss 46 of the movable scroll 42. The accommodation portion 56 also functions as a temporary storage for collecting the lubricating oil LO that has finished lubricating the compression element 40.

Figure 5:
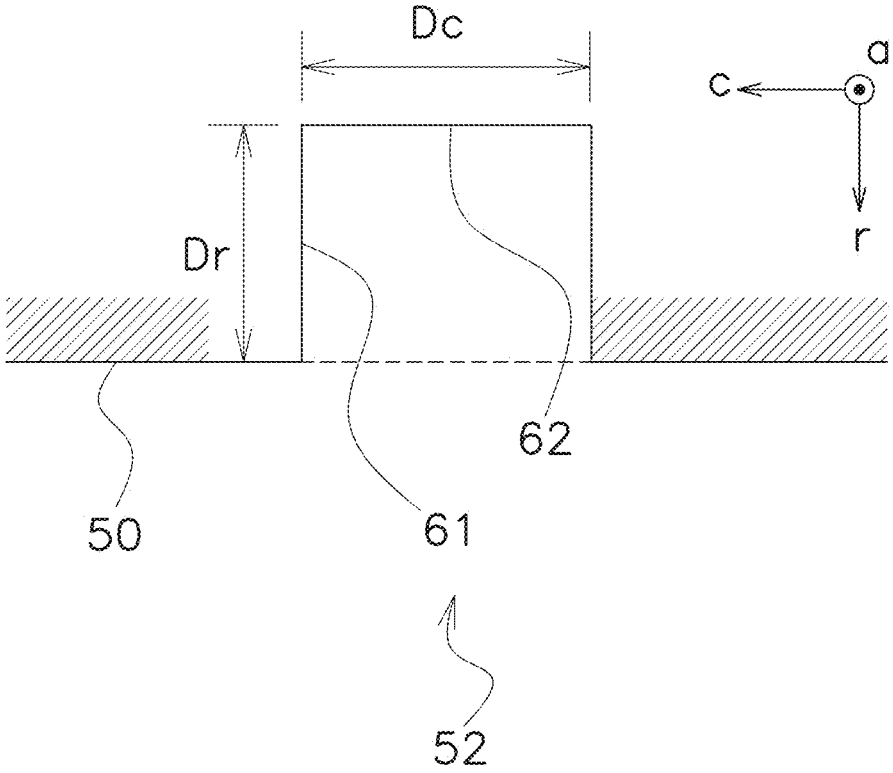
FIG. 5 is a schematic diagram showing a cross section of a second flow path 52 according to the first embodiment.

FIG. 5 shows a sectional shape of the narrow portion 59. The narrow portion 59 has a cross section that is a quadrangle having a first side 61 extending in the radial direction r of the casing 10 and a second side 62 extending in the circumferential direction c. A length Dc of the second side 62 is less than three times a length Dr of the first side 61 or less. The length Dc of the second side 62 is preferably one time the length Dr of the first side 61 or more.

(4) Movement of Refrigerant and Lubricating Oil

Figure 6:
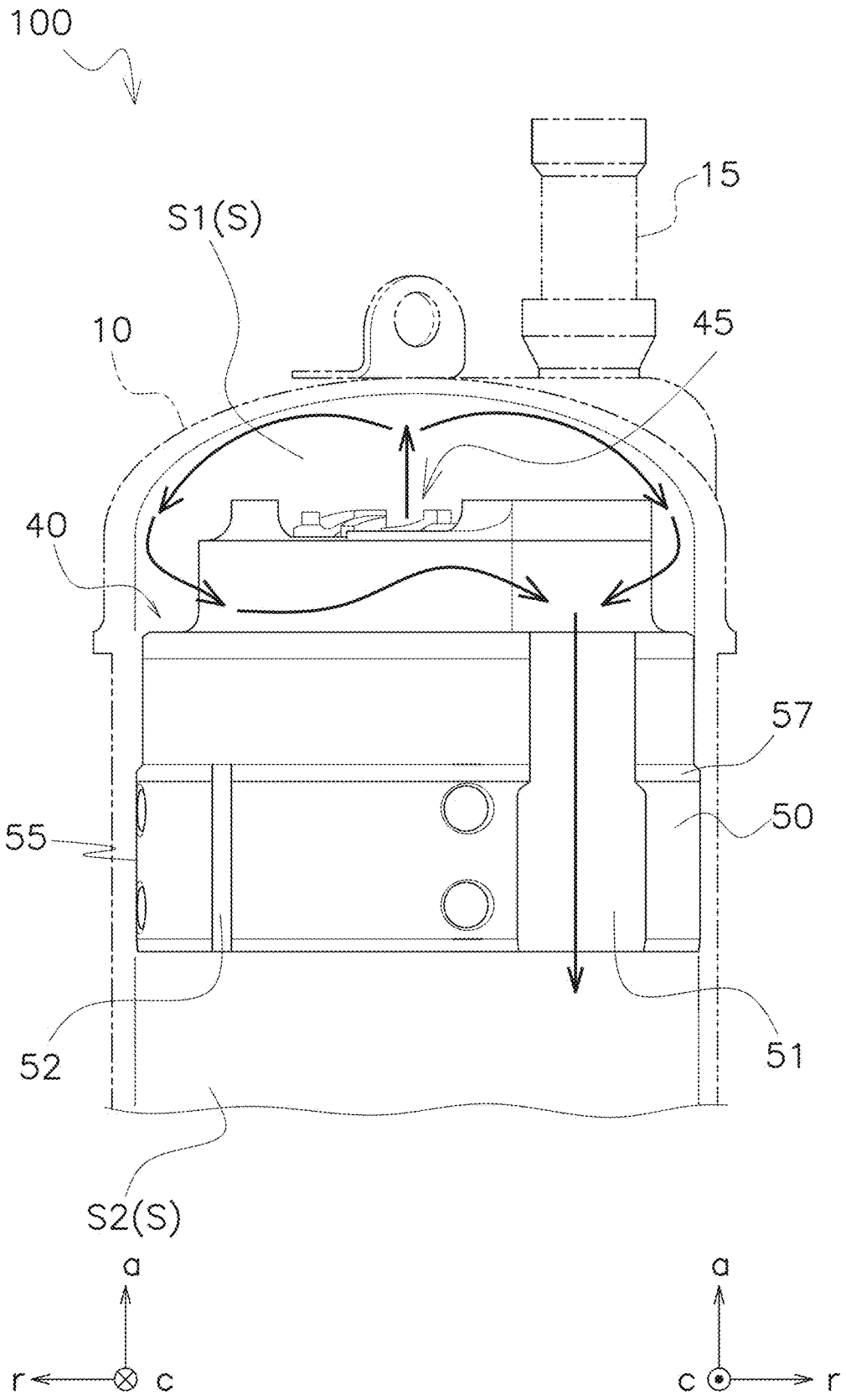
FIG. 6 is a schematic diagram showing movement of a refrigerant.

FIG. 6 shows movement of the refrigerant. The movement of the refrigerant is represented by a thick solid arrow.

The refrigerant compressed into a high pressure state is discharged from discharge hole 45 into the first space S1. The refrigerant collides with the upper portion 12 of the casing 10 surrounding the first space S1 or moves along an inner surface of the upper portion 12. Thereafter, the refrigerant passes through the first flow path 51 and moves to the second space S2. The refrigerant hardly passes through the second flow path 52 due to resistance generated by the small dimensions Dr and Dc, in other words, the small hydraulic diameter D.

Usually, the refrigerant has compatibility. Therefore, the refrigerant filling the first space S1 includes a certain lubricating oil LO. A part of the lubricating oil LO passes through the first flow path 51 and moves to the second space S2 as the refrigerant moves.

Figure 7:
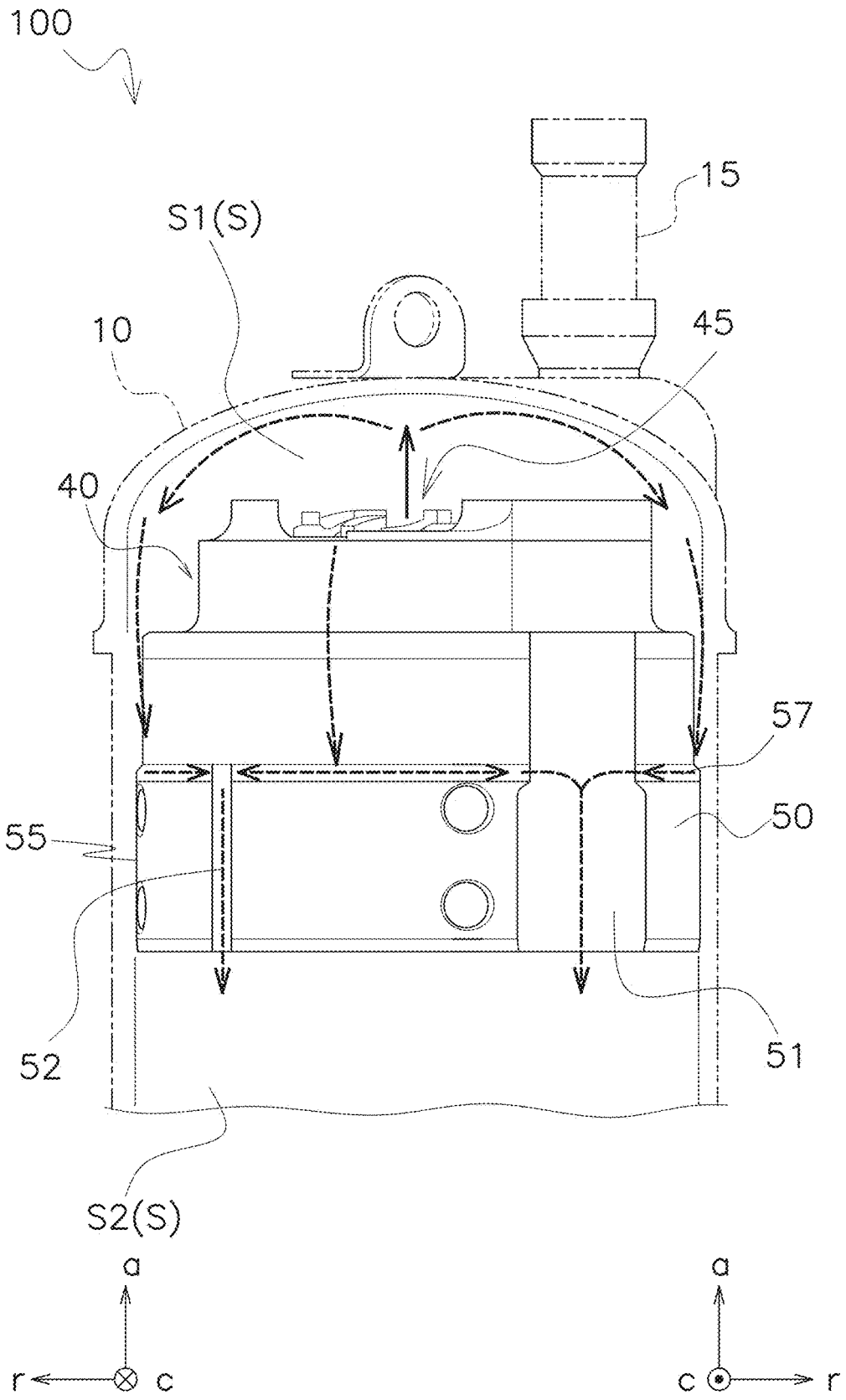
FIG. 7 is a schematic diagram showing movement of a lubricating oil LO.

FIG. 7 shows the movement of the rest of the lubricating oil LO. The movement of the lubricating oil LO is represented by a thick dashed arrow.

When the refrigerant in the first space S1 collides with the upper portion 12 of the casing 10, a certain amount of the lubricating oil LO is separated from the refrigerant and becomes oil droplets adhering to the inner surface of the upper portion 12. The lubricating oil LO in the oil droplet state is then subjected to an action of gravity, and descends downward along the inner surface of the upper portion 12. The oil droplets of the lubricating oil LO then gather at the stepped portion 57. The lubricating LO oil moves along the inner circumference Ci of the body 11 of the casing 10 and the stepped portion 57. Thereafter, the lubricating oil LO in a liquid state passes through the first flow path 51 or the second flow path 52 by the action of gravity and moves to the second space S2. Thereafter, the lubricating oil LO falls into the oil reservoir 14.

(5) Characteristics (5-1)

Conventionally, a scroll compressor accommodates a refrigerant and lubricating oil. When a compression process is completed, the refrigerant is discharged from the scroll compressor. In contrast, the lubricating oil is expected to remain in the scroll compressor. However, since the lubricating oil exhibits compatibility with the refrigerant, a phenomenon called "oil loss" in which the lubricating oil is exhausted to the outside of the scroll compressor together with the refrigerant can occur in the conventional compressors.

Regarding the scroll compressor 100 according to the present embodiment of this disclosure, in addition to the first flow path 51 for the refrigerant, the second flow path 52 dedicated to the lubricating oil LO is provided in the partitioning member 50. Since the narrow portion 59 of the second flow path 52 has a shape defined by $0.01 \leq D/L \leq 0.07$ or $0.03 \leq D/L \leq 0.06$, the second flow path 52 allows the lubricating oil LO in a liquid state to pass through and exhibits resistance to the refrigerant in a gas state. Therefore, since opportunities of mixing the refrigerant and the lubricating oil LO are reduced, oil loss is suppressed.

Figure 8:
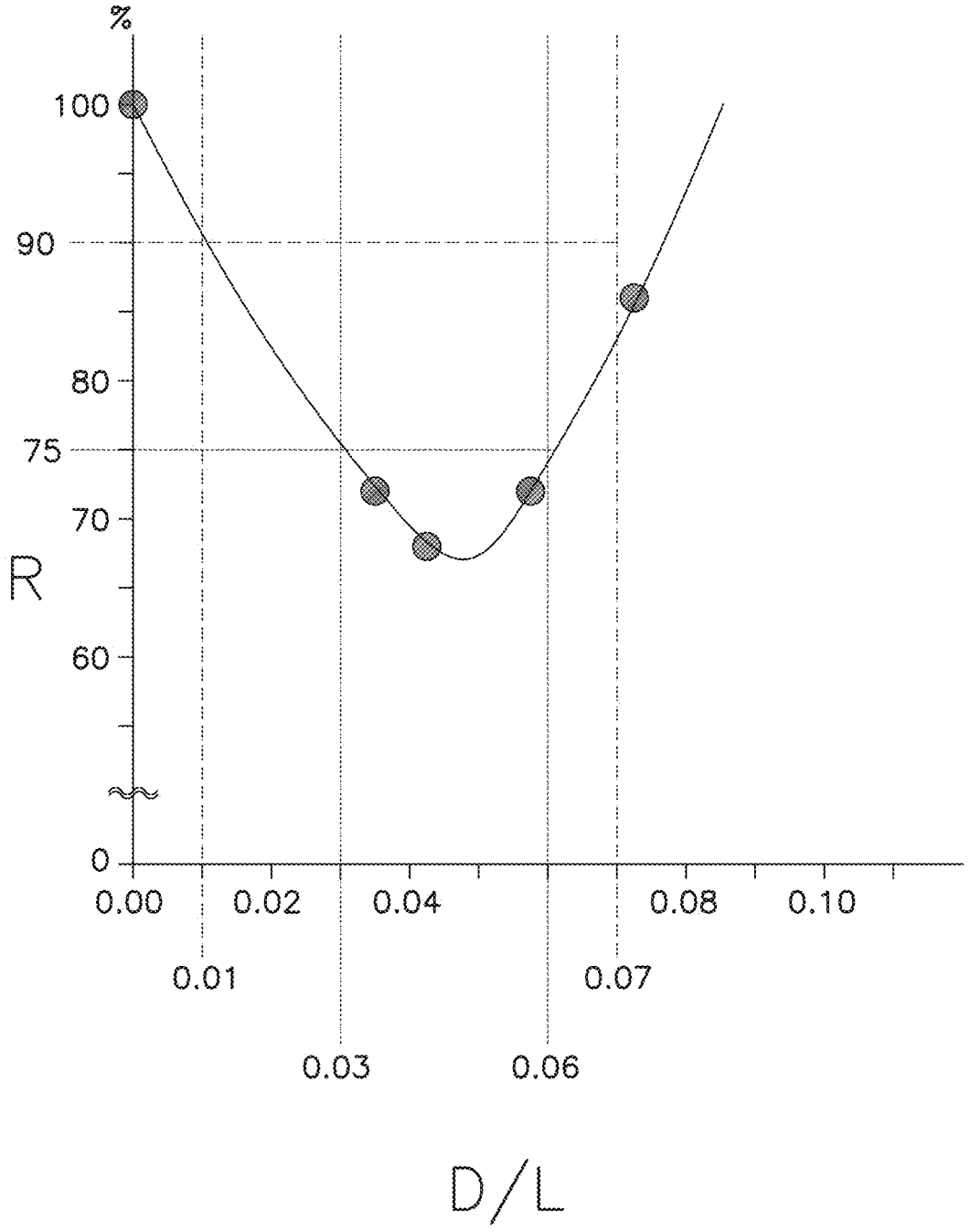
FIG. 8 is a graph showing an effect of suppressing oil loss.

FIG. 8 is a graph showing an effect of suppressing oil loss caused by the second flow path 52. A horizontal axis indicates the ratio D/L of the hydraulic diameter D of the narrow portion 59 to the length L of the narrow portion 59. A vertical axis represents an oil loss ratio R (%) and is expressed as a percentage with an ordinate intercept of 100%. The larger the oil loss ratio R, the larger the amount of the lubricating oil LO exhausted from the scroll compressor 100.

As shown in the drawing, in a region of $0.01 \leq D/L \leq 0.07$ on the horizontal axis, the oil loss ratio R is reduced to about 90% or less. Furthermore, in a region of $0.03 \leq D/L \leq 0.06$ on the horizontal axis, the oil loss ratio R is reduced to about 75% or less. For the ratio $D/L=0.05$, the oil loss ratio R has a minimum value of about 67%.

(5-2)

The narrow portion 59 of the second flow path 52 has the length L of 5 mm or more and 80 mm or less. Therefore, since the length L that generates resistance against the refrigerant is secured, oil loss is suppressed.

(5-3)

The partitioning member 50 that isolates the first space S1 from the second space S2 does not compress the refrigerant. Thus, the design of the narrow portion 59 is less constrained by the design of the compression element 40.

(5-4)

The length Dc of the second side 62 is three times the length Dr of the first side 61 or less. Therefore, since the lengths of the second side 62 and the first side 61 are close, the narrow portion 59 does not need to have an extreme flat structure, and processing for manufacturing is easy.

(5-5)

The stepped portion 57 faces the first space S1. Therefore, since the stepped portion 57 collects the lubricating oil LO existing in the first space S1 and guides the lubricating oil LO to the second flow path 52, the opportunities of mixing the refrigerant and the lubricating oil LO are further reduced.

(6) Modifications

Description is made hereinafter to modifications of the first embodiment. For example, plurality of modifications may be combined together.

(6-1) Modification 1A

In the first embodiment, the cross section of the narrow portion 59 is a quadrangle. Alternatively, the cross section of the narrow portion 59 may be triangular.

Figure 9:
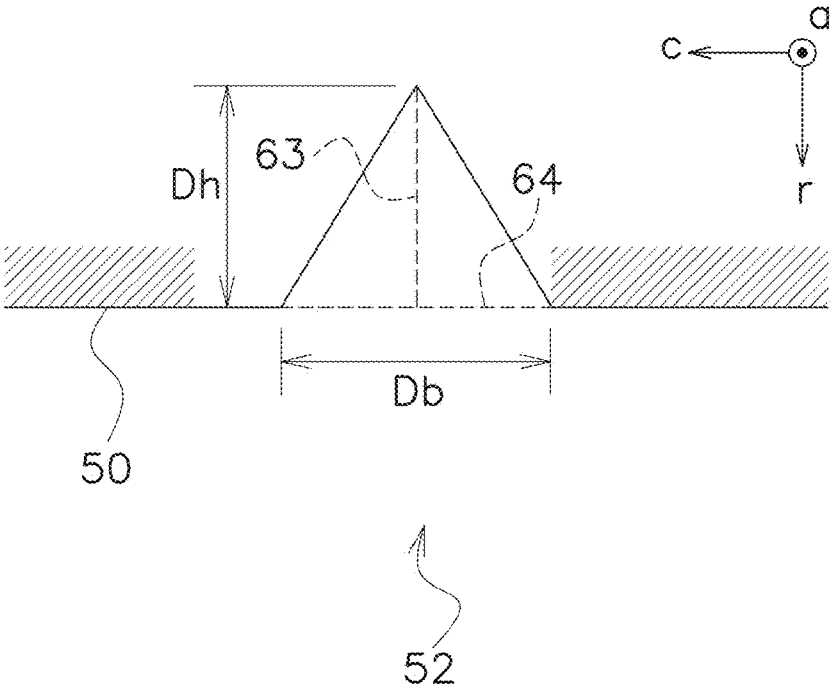
FIG. 9 is a schematic diagram showing a cross section of a second flow path 52 according to a first modification 1A of the first embodiment.

FIG. 9 shows a cross section of a narrow portion 59 according to a first modification 1A of the first embodiment. The cross section has a cross section having a triangular shape having a height 63 extending in the radial direction r of the casing 10 and a base 64 extending in the circumferential direction c of the casing 10. A dimension Ds of the base 64 is three times a dimension Dh of the height 63 or less. The dimension Ds of the base 64 is preferably one time the dimension Dh of the height 63 or more.

In this configuration, a dimension Db of the base 64 is three times a dimension Dh of the height 63 or less. Therefore, since the two dimensions are close, the narrow portion 59 does not need to have an extreme flat structure, and the processing for manufacturing is easy.

(6-2) Modification 1B

In the first embodiment, the cross section of the narrow portion 59 is a quadrangle. Alternatively, the cross section of the narrow portion 59 may be semi-elliptical.

Figure 10:
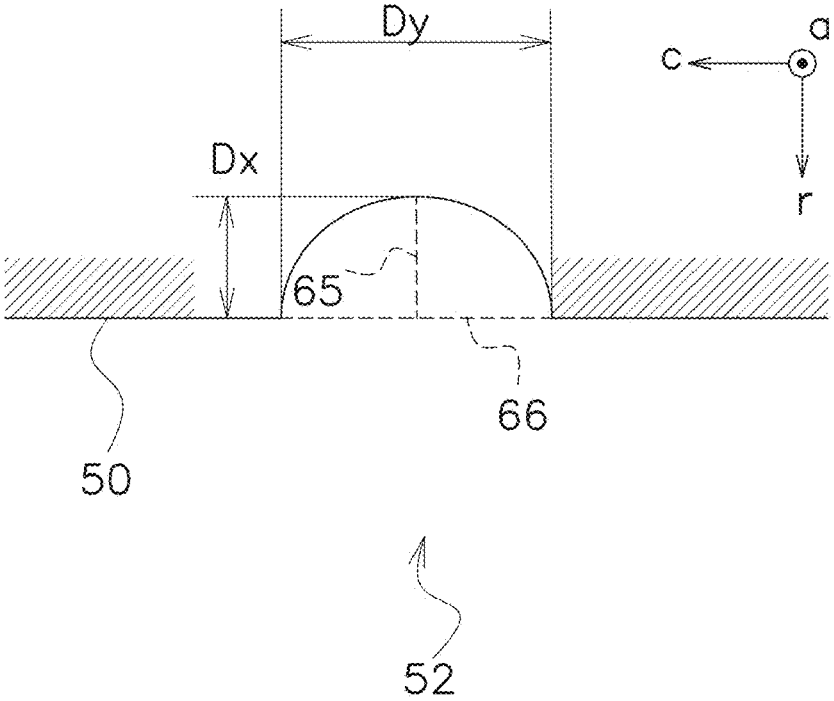
FIG. 10 is a schematic diagram showing a cross section of a second flow path 52 according to a second modification 1B of the first embodiment.

FIG. 10 shows a cross section of a narrow portion 59 according to a second modification 1B of the first embodiment. The shape of the cross section is a semi-elliptical shape having a first axial radius 65 extending in the radial direction r of the casing 10 and a second axial diameter 66 extending in the circumferential direction c. A dimension Dy of the second axial diameter 66 is three times a dimension Dx of the first axial radius 65 or less. The dimension Dy of the second axial diameter 66 is preferably one time the dimension Dx of the first axial radius 65 or more.

Alternatively, instead of a semi-elliptical shape, the shape of the cross section may be a semi-circular shape such that the dimension Dy of the second axial diameter 66 is exactly twice the dimension Dx of the first axial radius 65.

In this configuration, the narrow portion 59 has a semi-circular or semi-elliptical shape. Therefore, processing for forming the narrow portion 59 is easy.

(6-3) Modification 1C

In the first embodiment, the partitioning member 50 is a separate component from the compression element 40. Alternatively, the partitioning member 50 may belong to the compression element 40.

Figure 11:
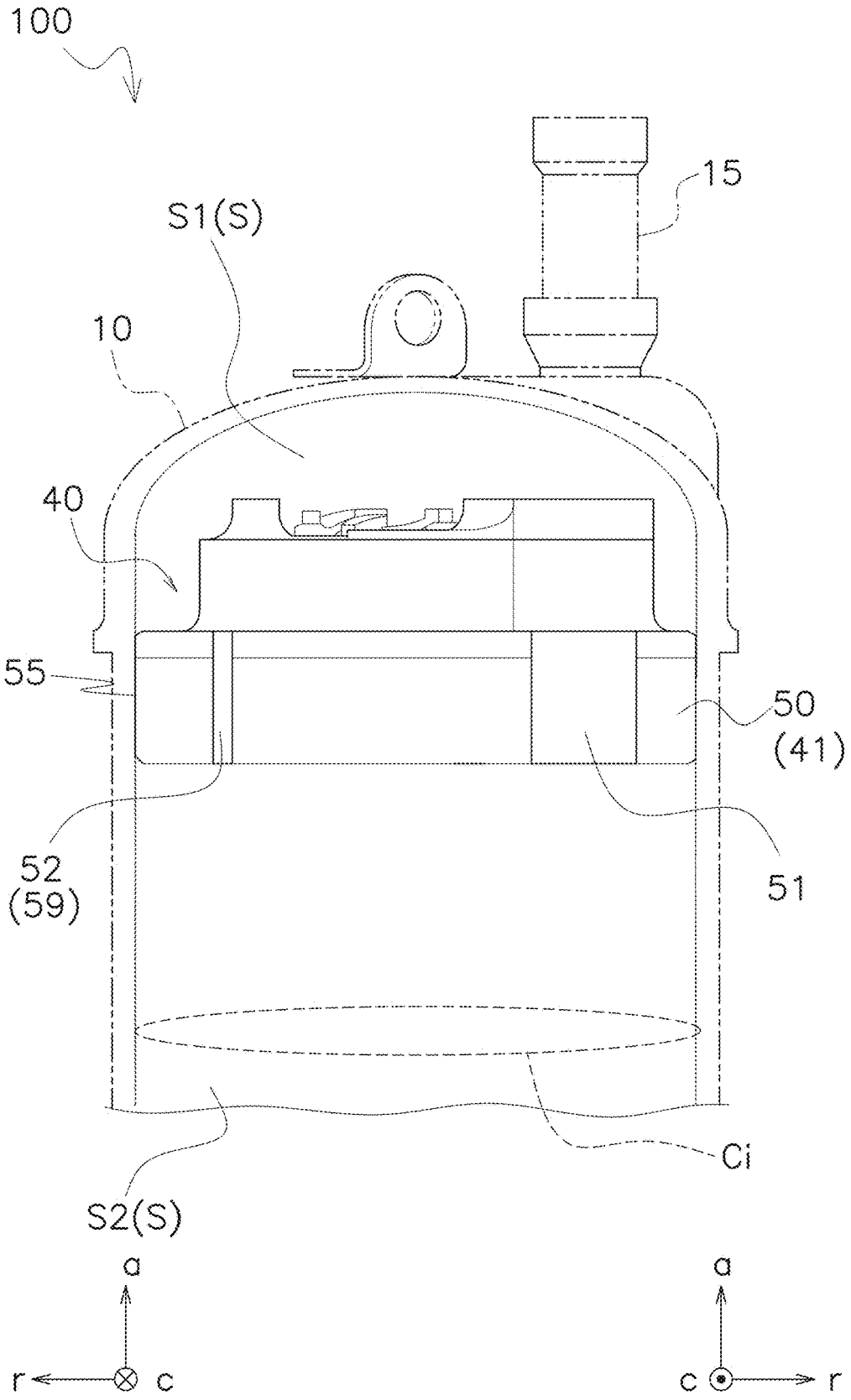
FIG. 11 is a schematic diagram of a main part of a scroll compressor 100 according to a third modification 1C of the first embodiment.

FIG. 11 shows a scroll compressor 100 according to a third modification 1C of the first embodiment. The compression element 40 of the scroll compressor 100 includes the fixed scroll 41. The fixed scroll 41 also functions as the partitioning member 50, and divides the internal space S into the first space S1 and the second space S2. The fixed scroll 41 has the fixing surface 55. The fixing surface 55 is fixed to the body of the casing 10.

One first flow path 51 and one second flow path 52 are provided on the fixing surface 55. The second flow path 52 is spaced apart from the first flow path 51. The first flow path 51 allows the refrigerant to pass from the first space S1 to the second space S2. The second flow path 52 is configured to guide the lubricating oil LO to the second space S2. The structure of the narrow portion 59 of the second flow path 52 is similar to the configuration according to the first embodiment.

In this configuration, the fixed scroll 41 also isolates the first space S1 from the second space S2. Therefore, the number of components of the scroll compressor 100 can be reduced.

(6-4) Modification 1D

In the first embodiment, one first flow path 51 and one second flow path 52 are provided on the fixing surface 55 of the partitioning member 50. Alternatively, a plurality of first flow paths 51 or a plurality of second flow paths 52 may be provided in the partitioning member 50. In particular, providing the plurality of second flow paths 52 promotes movement of the lubricating oil LO from the first space S1 to the second space S2, and thus effectively suppresses oil loss.

Second Embodiment (1) Configuration

Figure 12:
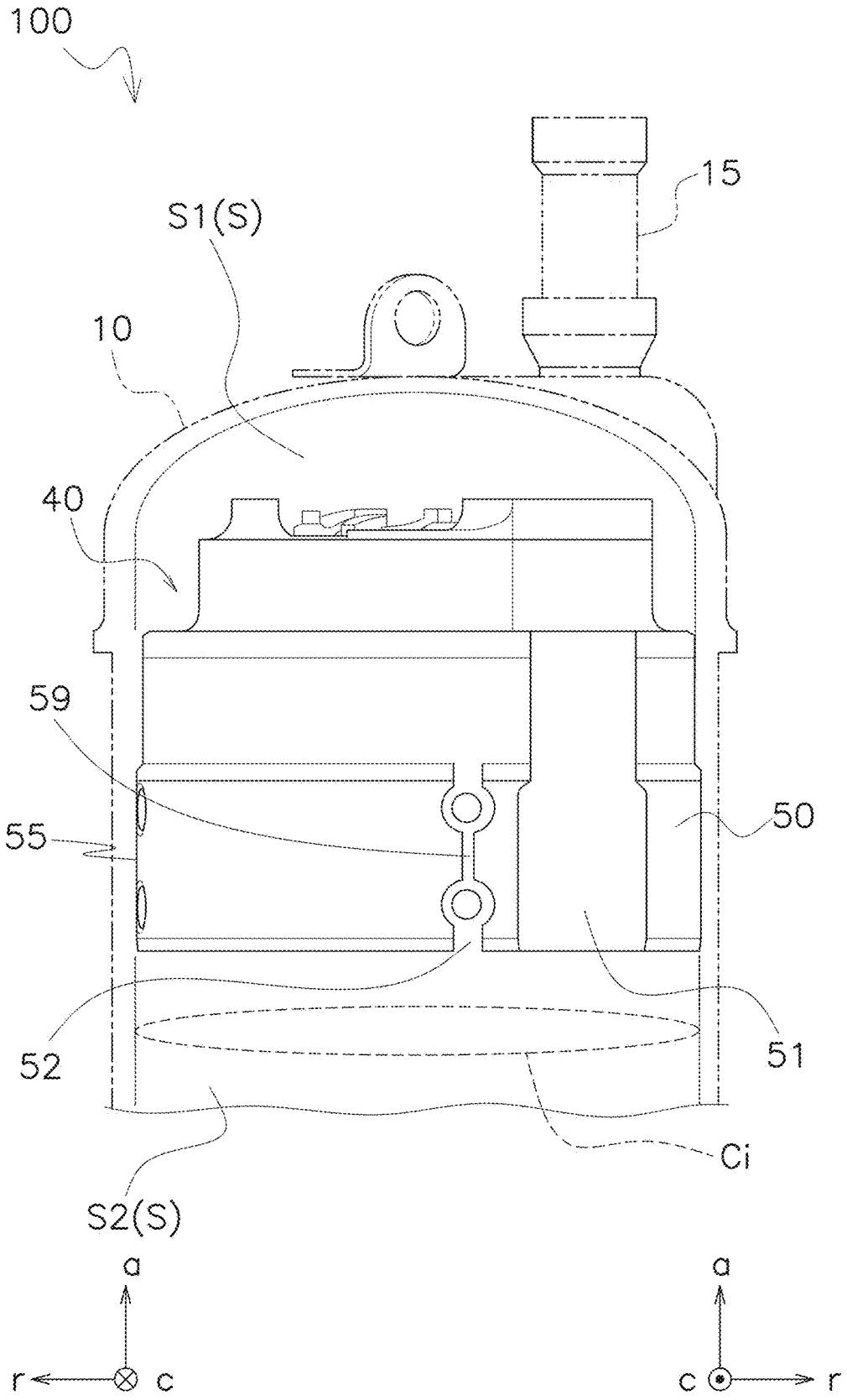
FIG. 12 is a schematic diagram of a main part of a scroll compressor 100 according to a second embodiment.

FIG. 12 shows a configuration of a scroll compressor 100 according to a second embodiment. The second embodiment is different from the first embodiment in the structure of the second flow path 52.

Figure 13:
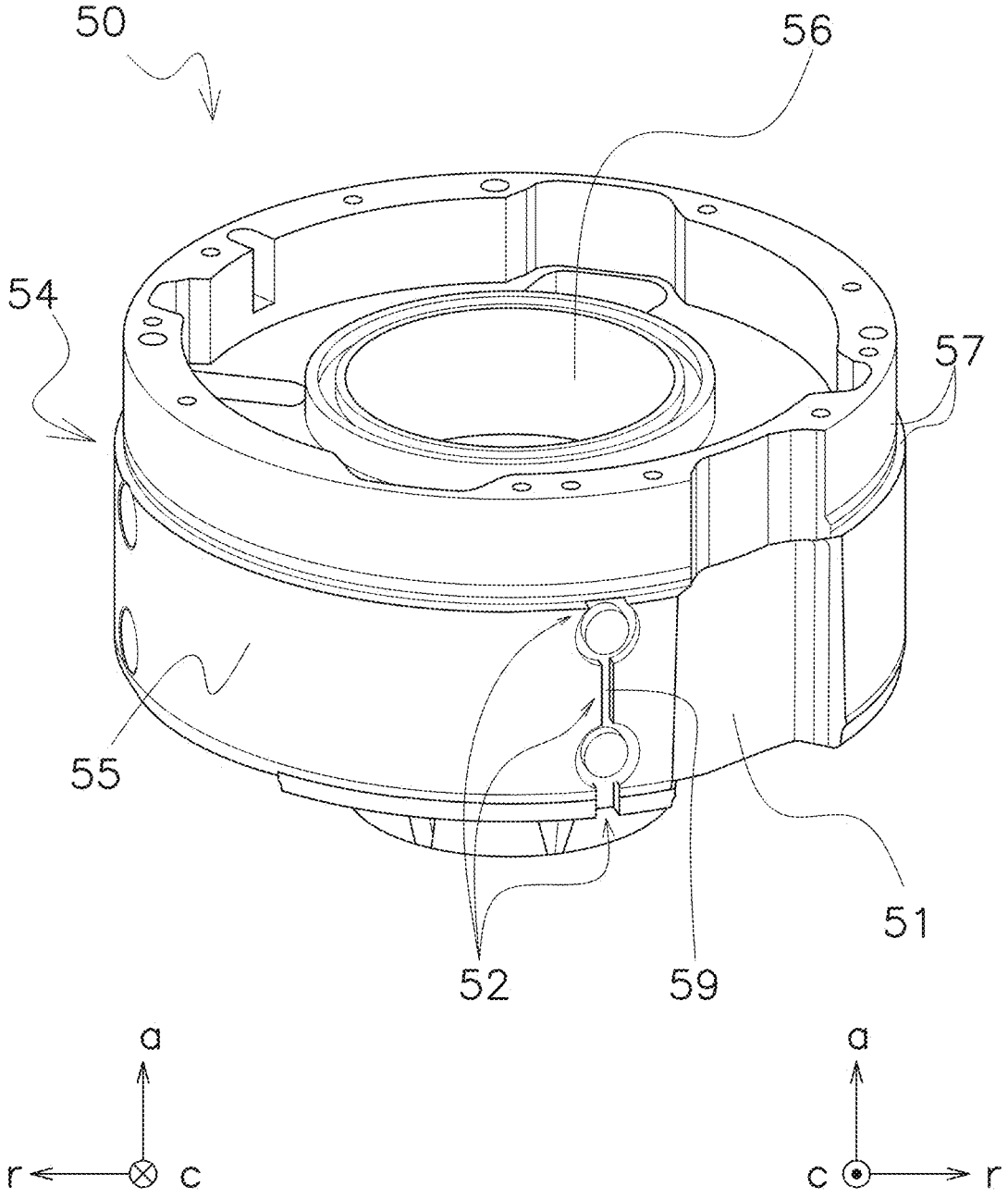
FIG. 13 is a perspective view of a partitioning member 50 according to the second embodiment.

The scroll compressor 100 includes the partitioning member 50. As shown in FIG. 13, the fixing surface 55 and the stepped portion 57 exist on the peripheral edge 54 of the partitioning member 50 as in the first embodiment. The first flow path 51 and the second flow path 52 are provided on the fixing surface 55. The second flow path 52 is configured to guide the lubricating oil LO to the second space S2. The second flow path is provided by utilizing a welded part between the partitioning member 50 and the casing 10.

Figure 14:
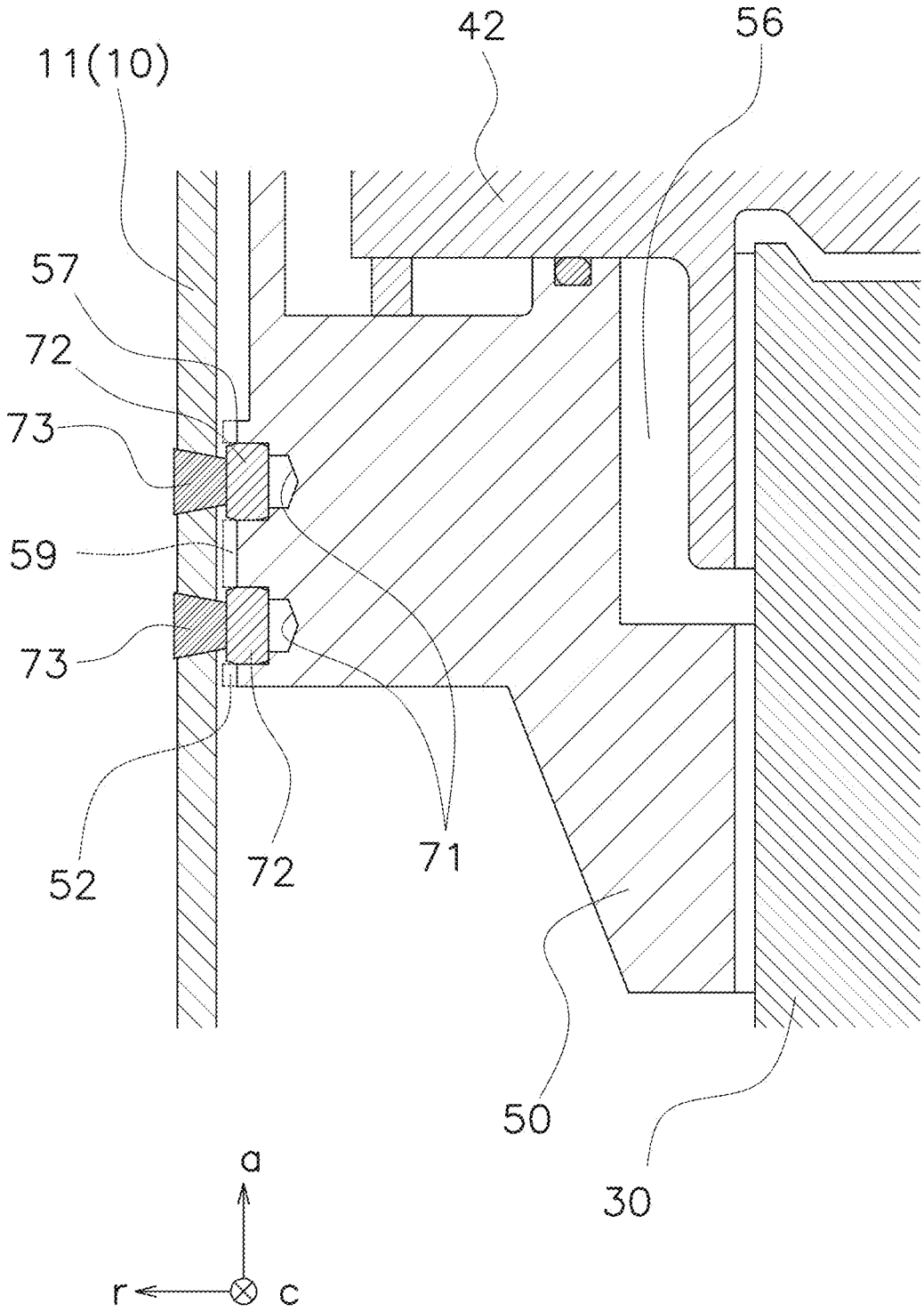
FIG. 14 is a sectional view of a scroll compressor 100 according to the second embodiment.

FIG. 14 shows the welded part between the partitioning member 50 and the casing 10. The partitioning member 50 is provided with a plurality of accommodation holes 71. Each of the accommodation holes 71 is configured to accommodate a fixing member 72. Each fixing member 72 is press-fitted and fixed to the accommodation hole 71. Unlike the partitioning member 50, the fixing member 72 includes a material to which molten metal is easily fixed. In the manufacture of the scroll compressor 100, when a portion of the casing 10 is heated and melted, the molten metal comes into contact with the fixing member 72. Thereafter, the molten metal solidifies and becomes a welded portion 73 fixed to the fixing member 72.

(2) Characteristics

In this configuration, the second flow path 52 and the narrow portion 59 which is a part of the second flow path are formed by using the welded part. Therefore, since an existing structure can be used, a large-scale design change is not required.

(3) Modifications

At least some of the modifications 1A to 1D of the first embodiment described above may be applied to the second embodiment.

CONCLUSION

The embodiments of the present disclosure have been described above. It is understood that various changes to modes and details should be available without departing from the gist and scope of the present disclosure recited in the claims.

The invention claimed is:

1. A scroll compressor comprising:

a casing having a cylindrical shape and including an internal space in which a lubricating oil exists;

a partitioning member fixed to the casing and dividing the internal space into a first space and a second space;

a compression element including a fixed scroll and a movable scroll movable relative to the fixed scroll to discharge a refrigerant to the first space;

a first flow path provided in the partitioning member and allowing the refrigerant to pass from the first space to the second space; and a second flow path provided in the partitioning member so as to be apart from the first flow path, the second flow path being configured to guide the lubricating oil to the second space, and including a narrow portion having a smallest flow path area, a ratio of a hydraulic diameter of the narrow portion to a length of the narrow portion in an axial direction of the casing being 0.01 to 0.07.

2. The scroll compressor according to claim 1, wherein the ratio of the hydraulic diameter of the narrow portion to the length of the narrow portion is 0.03 to 0.06.

3. The scroll compressor according to claim 1, wherein the length of the narrow portion is 5 mm to 80 mm.

4. The scroll compressor according to claim 1, wherein the partitioning member is a component separate from the compression element.

5. The scroll compressor according to claim 1, wherein the partitioning member includes the fixed scroll.

6. The scroll compressor according to claim 1, wherein the narrow portion has a cross section having a quadrangular shape having a first side extending in a radial direction of the casing and a second side extending in a circumferential direction of the casing by a length three times a length of the first side or less.

7. The scroll compressor according to claim 1, wherein the narrow portion has a cross section having a triangular shape having
a height extending in the radial direction of the casing and
a base extending in the circumferential direction of the casing by a length three times the height or less.

8. The scroll compressor according to claim 1, wherein the narrow portion has a cross section having a semicircular or semi-elliptical shape.

9. The scroll compressor according to claim 1, wherein the partitioning member includes a stepped portion that receives the lubricating oil that moves from the first space, and
the second flow path communicates with the stepped portion.

10. A refrigeration apparatus including the scroll compressor according to claim 1.

11. A scroll compressor comprising:
a cylindrical casing having a cylindrical shape and including an internal space in which a lubricating oil exists;
a partitioning member fixed to the casing and dividing the internal space into a first space and a second space;
a compression element including a fixed scroll, a movable scroll movable relative to the fixed scroll, and a discharge hole that faces the first space;
a first flow path provided in the partitioning member, connecting the first space and the second space, and having a dimension of 2 mm or more in a radial direction of the partitioning member; and
a second flow path provided in the partitioning member so as to be apart from the first flow path, the second flow path
connecting the first space and the second space, and
including a narrow portion having a smallest flow path area,
a ratio of a hydraulic diameter of the narrow portion to a length of the narrow portion in an axial direction of the casing being 0.01 to 0.07.

12. The scroll compressor according to claim 11, wherein the ratio of the hydraulic diameter of the narrow portion to the length of the narrow portion is 0.03 to 0.06.

13. The scroll compressor according to claim 11, wherein the length of the narrow portion is 5 mm to 80 mm.

14. The scroll compressor according to claim 11, wherein the partitioning member is a component separate from the compression element.

15. The scroll compressor according to claim 11, wherein the partitioning member includes the fixed scroll.

16. The scroll compressor according to claim 11, wherein the narrow portion has a cross section having a quadrangular shape having
a first side extending in a radial direction of the casing and
a second side extending in a circumferential direction of the casing by a length three times a length of the first side or less.

17. The scroll compressor according to claim 11, wherein the narrow portion has a cross section having a triangular shape having
a height extending in the radial direction of the casing and
a base extending in the circumferential direction of the casing by a length three times the height or less.

18. The scroll compressor according to claim 11, wherein the narrow portion has a cross section having a semicircular or semi-elliptical shape.

19. The scroll compressor according to claim 11, wherein the partitioning member includes a stepped portion that receives the lubricating oil that moves from the first space, and
the second flow path communicates with the stepped portion.

20. A refrigeration apparatus including the scroll compressor according to claim 11.

* * * * *